US009637847B2

(12) United States Patent
Terai et al.

(10) Patent No.: US 9,637,847 B2
(45) Date of Patent: May 2, 2017

(54) SHOE UPPER AND METHOD FOR KNITTING SHOE UPPER

(71) Applicant: SHIMA SEIKI MFG., LTD., Wakayama-shi, Wakayama (JP)

(72) Inventors: Kenta Terai, Wakayama (JP); Yoshinori Shimasaki, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 15/308,248

(22) PCT Filed: Apr. 17, 2015

(86) PCT No.: PCT/JP2015/061895
§ 371 (c)(1),
(2) Date: Nov. 1, 2016

(87) PCT Pub. No.: WO2015/166824
PCT Pub. Date: Nov. 5, 2015

(65) Prior Publication Data

US 2017/0065025 A1 Mar. 9, 2017

(30) Foreign Application Priority Data

May 2, 2014 (JP) ..... 2014-095010

(51) Int. Cl.
*D04B 1/24* (2006.01)
*A43B 23/02* (2006.01)
*D04B 1/22* (2006.01)

(52) U.S. Cl.
CPC ..... *D04B 1/24* (2013.01); *A43B 23/0245* (2013.01); *A43B 23/0265* (2013.01); *D04B 1/22* (2013.01)

(58) Field of Classification Search
CPC ..... D04B 1/22; D04B 1/24; A43B 23/0245; A43B 23/0265
See application file for complete search history.

(56) References Cited

U.S. PATENT DOCUMENTS 8,448,474 B1 5/2013 Tatler et al.
2010/0154256 A1* 6/2010 Dua ..... A43B 1/04 36/25 R (Continued)

FOREIGN PATENT DOCUMENTS

JP 5391493 B2 1/2014
JP 2014-508009 A 4/2014

(Continued)

OTHER PUBLICATIONS

International Search Report issued for International Application No. PCT/JP2015/061895 dated Jul. 14, 2015, 2 pages.

*Primary Examiner* — Danny Worrell
(74) *Attorney, Agent, or Firm* — Rothwell, Figg, Ernst & Manbeck, P.C.

(57) ABSTRACT

There is provided a shoe upper that is less likely to stretch, and a method for knitting the shoe upper. A shoe upper (1) includes a linear anti-stretch section (4), knitted integrally to an instep cover section (3), for suppressing stretching of the instep cover section (3). The anti-stretch section (4) includes a pipe-form knitted fabric portion (40) configured with a knitting yarn including a heat fusible yarn, and an inserting knitting yarn (41) inserted inside the pipe-form knitted fabric portion (40) and fixed by tuck to stitches configuring the pipe-form knitted fabric portion (40). The pipe-form knitted fabric portion (40) is configured by an inner knitted fabric part (40*i*) and an outer knitted fabric part (40*o*) that overlap in a thickness direction of the instep cover section (3), a starting end in a wale direction of the inner knitted fabric part (40*i*) and a starting end in a wale direction of the (Continued)

outer knitted fabric part (40*o*) being joined, and a terminating end in the wale direction of the inner knitted fabric part (40*i*) and a terminating end in the wale direction of the outer knitted fabric part (40*o*) being joined to form a pipe shape.

4 Claims, 4 Drawing Sheets

(56) References Cited

U.S. PATENT DOCUMENTS

2012/0233882 A1* 9/2012 Huffa ..... A43B 1/04 36/45
2012/0318024 A1* 12/2012 Mori ..... B65H 23/195 65/90
2013/0145652 A1* 6/2013 Podhajny ..... A43B 23/0245 36/50.1
2013/0212907 A1* 8/2013 Dua ..... A43B 23/0245 36/83
2013/0239438 A1* 9/2013 Dua ..... A43B 1/04 36/84
2013/0239625 A1* 9/2013 Meir ..... A43B 23/0245 66/170
2013/0318837 A1* 12/2013 Dua ..... A43B 1/04 36/9 R
2014/0068968 A1* 3/2014 Podhajny ..... A43B 23/0245 36/50.1
2014/0144190 A1* 5/2014 Tatler ..... A43B 23/0245 66/170
2014/0150296 A1* 6/2014 Dua ..... A43B 23/0245 36/84
2014/0230277 A1* 8/2014 Dua ..... A43B 1/04 36/84
2014/0237855 A1* 8/2014 Podhajny ..... A43B 23/0245 36/84
2014/0245545 A1* 9/2014 Meir ..... A43B 23/0245 12/142 G
2014/0245639 A1* 9/2014 Dua ..... A43B 1/04 36/87
2014/0245643 A1* 9/2014 Huffa ..... A43B 1/04 36/9 R

FOREIGN PATENT DOCUMENTS

WO 2010/080182 A1 7/2010
WO 2012/125473 A2 9/2012
WO 2014/013790 A1 1/2014

* cited by examiner

SHOE UPPER AND METHOD FOR KNITTING SHOE UPPER

CROSS REFERENCE TO RELATED APPLICATION

This application is a 35 U.S.C. 371 National Phase Entry Application from PCT/JP2015/061895, filed Apr. 17, 2015, which claims the benefit of Japan Patent Application No. 2014-095010 filed on May 2, 2014, the disclosure of which is incorporated herein in its entirety by reference.

TECHNICAL FIELD

The present invention relates to a shoe upper and a method for knitting the same.

BACKGROUND ART

A shoe includes a shoe upper with a sole cover section that covers a sole of a wearer, and an instep cover section that covers a portion on an instep side of the wearer. In outdoor shoes, an outer sole made of synthetic resin and the like is attached to the sole cover section of the shoe upper.

In recent years, attempts have been made to configure the instep cover section, of the sole cover section and the instep cover section configuring the shoe upper, with one knitted fabric to produce the shoe with high productivity. For example, in Patent Documents 1 and 2, the instep cover section in a planarly developed state is produced with one knitted fabric, which is then joined to the outer sole made of synthetic resin and the like along with the sole cover section to complete the shoe.

The shoe upper may be stretched out of shape when used repeatedly. As a countermeasure, in the shoe upper of Patent Document 1, a tube is formed in the instep cover section, and a wire is inserted inside the tube. Furthermore, in the shoe upper of Patent Document 2, an inlay knitting yarn is interwoven into the instep cover section to suppress the stretching of the instep cover section.

PRIOR ART DOCUMENTS

Patent Documents

[Patent Document 1] Japanese Patent No. 5391493

[Patent Document 2] Japanese Unexamined Patent Application Publication No. 2014-508009

DISCLOSURE OF THE INVENTION

Problems to be Solved by the Invention

The stretching of the shoe upper may not be sufficiently suppressed in the configuration of Patent Documents described above. In particular, when using a shoe upper for exercise, a considerably large force acts on the shoe upper thus possibly causing the shoe upper to stretch. Thus, development of a shoe upper that is less likely to stretch compared to the conventional shoe upper is desired.

The present invention has been made in view of the above circumstances and an object of the present invention is to provide a shoe upper that is less likely to stretch even if used repeatedly, and a method for knitting the shoe upper.

Means for Solving the Problems

An aspect of the present invention relates to a shoe upper including an instep cover section that covers a portion on an instep side of a wearer. The shoe upper of this invention includes a linear anti-stretch section, integrally arranged in the instep cover section by knitting, for suppressing stretching of the instep cover section. The anti-stretch section includes a pipe-form knitted fabric portion configured with a knitting yarn including a heat fusible yarn, and an inserting knitting yarn inserted inside the pipe-form knitted fabric portion and fixed by tuck to stitches configuring the pipe-form knitted fabric portion. The pipe-form knitted fabric portion of the anti-stretch section is configured by an inner knitted fabric part and an outer knitted fabric part that overlap in a thickness direction of the instep cover section, a starting end in a wale direction of the inner knitted fabric part and a starting end in a wale direction of the outer knitted fabric part being joined, and a terminating end in the wale direction of the inner knitted fabric part and a terminating end in the wale direction of the outer knitted fabric part being joined to form a pipe shape.

According to one aspect of the shoe upper of the present invention, a knitting width direction of the instep cover section is directed in a lengthwise direction of the shoe upper.

According to one aspect of the shoe upper of the present invention, a knitting width direction of the instep cover section is directed in a height direction of the shoe upper.

An aspect of the present invention relates to a method for knitting a shoe upper in which an instep cover section that covers a portion on an instep side of a wearer is knitted in a seamless manner using a flat knitting machine including a one-side needle bed and an other-side needle bed disposed opposite to each other. In the method for knitting the shoe upper of this invention, a linear anti-stretch section integrally formed in the instep cover section is knitted while knitting the instep cover section, the anti-stretch section including a pipe-form knitted fabric portion in which an inner knitted fabric part and an outer knitted fabric part overlapping in a thickness direction of the instep cover section are joined to a pipe shape, and an inserting knitting yarn inserted inside the pipe-form knitted fabric portion and fixed by tuck to stitches configuring the pipe-form knitted fabric portion. In the knitting of the anti-stretch section, the following processes $\alpha$ to $\gamma$ are carried out.

[Process $\alpha$] Knitting a starting end in a wale direction of the inner knitted fabric part and a starting end in a wale direction of the outer knitted fabric part joined with a knitting yarn including a heat fusible yarn.

[Process $\beta$] Knitting the inner knitted fabric part and the outer knitted fabric part with different needle beds, feeding the inserting knitting yarn different from the inner knitted fabric part and the outer knitted fabric part between the knitted fabric parts, and fixing the inserting knitting yarn by tuck to stitches of the inner knitted fabric part or stitches of the outer knitted fabric part.

[Process $\gamma$] Joining a terminating end in the wale direction of the inner knitted fabric part and a terminating end in the wale direction of the outer knitted fabric part by knitting.

The instep cover section may be knitted according to the following conditions A, B, or may be knitted according to the following conditions C, D.

[Condition A] Knit the instep cover section from the instep side toward the sole side, or knit the instep cover section from the sole side toward the instep side.

[Condition B] Knit the left side portion and the right side portion of the instep cover section with the one-side needle bed and the other-side needle bed, respectively.

The knitting method that satisfies the conditions A and B is described in the first embodiment and the modified embodiment 1-1, to be described later.

[Condition C] Knit the instep cover section from the heel side toward the toe side, or knit the instep cover section from the toe side toward the heel side.

[Condition D] Knit the left side portion and the right side portion of the instep cover section with the one-side needle bed and the other-side needle bed, respectively.

The knitting method that satisfies the conditions C and D is described in the second embodiment and the modified embodiment 2-1, to be described later.

Effects of the Invention

The shoe upper of the present invention is less likely to stretch even if used repeatedly. This is because the anti-stretch section configured by the pipe-form knitted fabric portion integrated to the instep cover section by knitting and the inserting knitting yarn fixed by tuck to the pipe-form knitted fabric portion restrict the stretching of the instep cover section. The pipe-form knitted fabric portion is a thick knitted fabric portion configured by the inner knitted fabric part and the outer knitted fabric part overlapping in the thickness direction of the instep cover section and hence is less likely to stretch, and furthermore, the inserting knitting yarn fixed by tuck to the pipe-form knitted fabric portion restricts the stretching of the pipe-form knitted fabric portion. As a result, the anti-stretch section configured by the pipe-form knitted fabric portion and the inserting knitting yarn sufficiently exerts the effect of suppressing the stretching of the instep cover section. Moreover, the inserting knitting yarn is not merely hooked to the pipe-form knitted fabric portion by tuck, but is also fused to the pipe-form knitted fabric portion by the heat fusible yarn contained in the pipe-form knitted fabric portion when the shoe upper is heat treated, whereby the inserting knitting yarn and the pipe-form knitted fabric portion are strongly integrated. Thus, the inserting knitting yarn is less likely to shift inside the pipe-form knitted fabric portion, and the shoe upper (instep cover section) is less likely to lose shape.

In the aspect in which the knitting width direction of the instep cover section is directed in the lengthwise direction of the shoe upper, the anti-stretch section integrally formed in the instep cover section is extended in the lengthwise direction of the shoe upper or is extended in a direction inclined with respect to the lengthwise direction. In particular, the stretch in the lengthwise direction of the shoe upper (instep cover section) can be further suppressed by forming the anti-stretch section in the left side portion and the right side portion of the instep cover section, and joining such anti-stretch sections at the position of the toe and the position of the heel of the instep cover section.

In the aspect in which the knitting width direction of the instep cover section is directed in the height direction of the shoe upper, the anti-stretch section integrally formed in the instep cover section is extended in the height direction of the shoe upper or is extended in a direction inclined with respect to the height direction. According to such anti-stretch section, the shoe upper (instep cover section) can be suppressed from being stretched and expanding toward the outer side.

According to the method for knitting the shoe upper of the present invention, the shoe upper of the present invention in which the anti-stretch section is integrated in the instep cover section can be knitted.

MODE FOR CARRYING OUT THE INVENTION

Hereinafter, embodiments of a shoe upper and a method for knitting the same according to the present invention will be described based on the drawings. In the embodiments, a two-bed flat knitting machine including at least a one-side needle bed and an other-side needle bed disposed opposite to each other in a front and back direction, the stitches being transferable between the needle beds, is used. The flat knitting machine to be used may, of course, be a four-bed flat knitting machine.

<First Embodiment >

<<Shoe Upper >>

Figure 1:
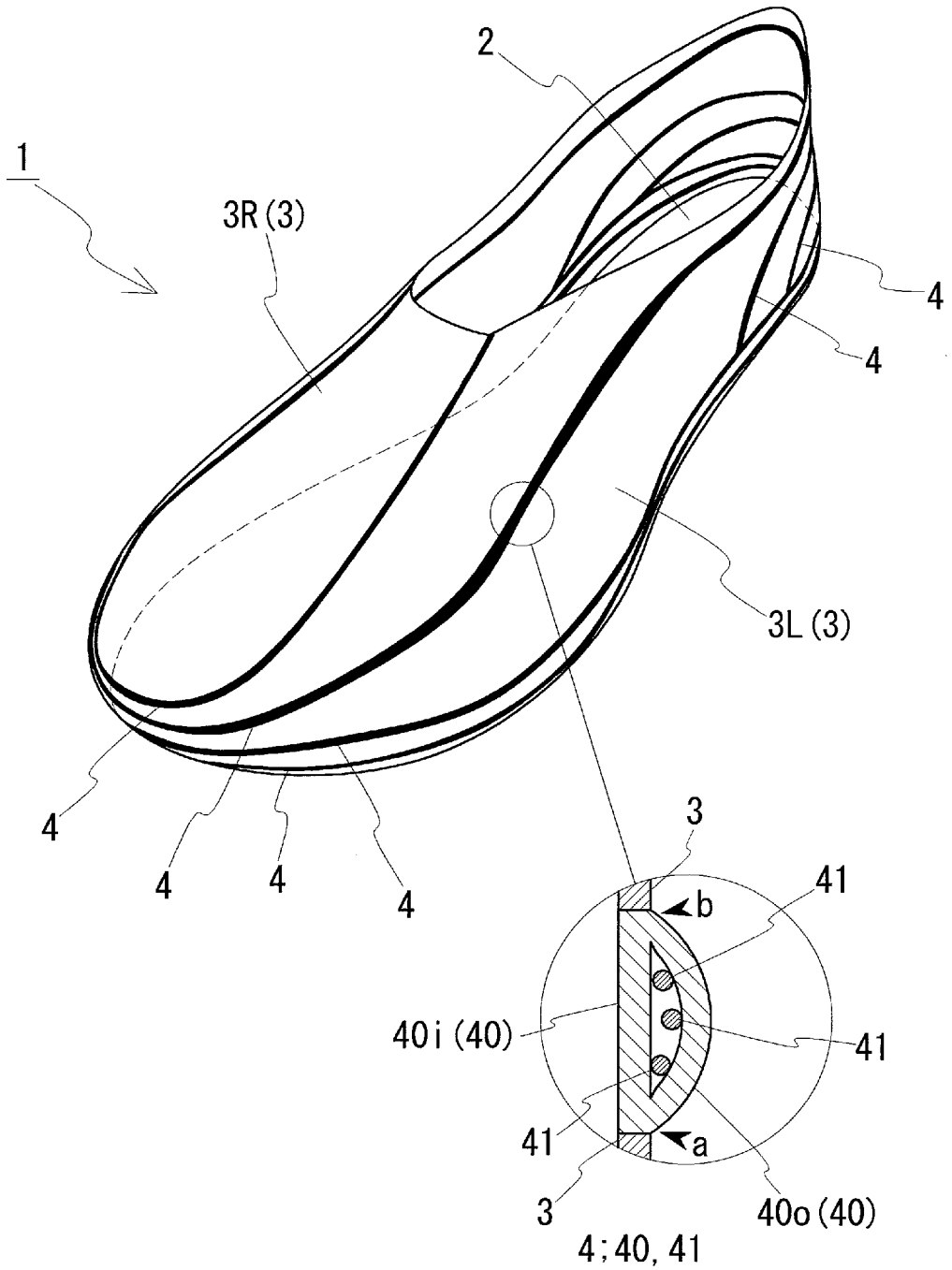
FIG. 1 is a schematic perspective view of a shoe upper according to a first embodiment.

A shoe upper 1 shown in FIG. 1 includes a sole cover section 2 that covers a sole portion of a wearer, and an instep cover section 3 that covers a portion on an instep side of the wearer. The shoe upper 1 may further include an outer sole (not shown) on the outer side of the sole cover section 2. The main features of the shoe upper 1 of the present embodiment lie in that a linear anti-stretch section 4 is provided, and in that the entire shoe upper 1 including the anti-stretch section 4 is a knitted fabric knitted integrally in a seamless manner. Each configuration of the shoe upper 1 will be described in detail below.

[Sole Cover Section and Instep Cover Section]

The sole cover section 2 and the instep cover section 3 are knitted fabrics formed by knitting. The direction of the stitches in each section 2, 3 changes according to the knitting direction of the shoe upper 1. For example, when knitting the shoe upper 1 from a sole side toward the instep side, the knitting width direction of each section 2, 3 is directed in a lengthwise direction (toe to heel direction) of the shoe upper 1, and the direction of the stitches in the instep cover section 3 in this case becomes upward. When knitting the shoe upper 1 from the instep side toward the sole side, on the other hand, the knitting width direction of each section 2, 3 is directed in the lengthwise direction of the shoe upper 1, and the direction of the stitches in the instep cover section 3 in this case becomes downward. The following description will be made assuming the shoe upper 1 of the first embodiment is knitted from the sole side toward the instep side. The knitting from the instep side toward the sole side will be described in the modified embodiment 1-1.

The sole cover section 2 and the instep cover section 3 may be knitted in a seamless manner without seam, or may be separately knitted and joined afterwards by sewing and the like. The former configuration is adopted in the present embodiment.

The sole cover section 2 and the instep cover section 3 are preferably knitted with a fusible knitting yarn including a heat fusible yarn. The shoe upper 1 can be three-dimensionally molded when the shoe upper 1 is fitted into a last (foot model) and subjected to heat treatment by knitting each section 2, 3 with the fusible knitting yarn. Each section 2, 3 may, of course, be knitted with a non-fusible knitting yarn not including the heat fusible yarn, or a part of each section 2, 3 may be knitted with the fusible knitting yarn and the remaining part may be knitted with the non-fusible knitting yarn.

[Anti-stretch Section]

The anti-stretch section 4 is integrally arranged in the instep cover section 3 by knitting, and has a function of suppressing the stretching of the instep cover section 3. As shown in FIG. 1, the designability of the instep cover section 3 (shoe upper 1) can be enhanced by having the color of the knitting yarn configuring the anti-stretch section 4 different from the color of the knitting yarn configuring the instep cover section 3.

As shown in FIG. 1, a plurality of anti-stretch sections 4 is preferably arranged on a main body left portion 3L, which is the left side portion of the instep cover section 3, and a main body right portion 3R, which is the right side portion of the instep cover section 3. In particular, the stretching of the instep cover section 3 can be effectively suppressed by arranging a plurality of anti-stretch sections 4 intensively at a portion where load tends to be applied during use such as the heel portion and the toe portion. Some of the anti-stretch sections 4, which are arranged on the heel side, are inclined with respect to the lengthwise direction of the shoe upper 1, but each of the anti-stretch sections 4 is extended substantially toward the lengthwise direction of the shoe upper 1. Furthermore, the entire instep cover section 3 can be suppressed from stretching outward by joining the anti-stretch section 4 of the main body left portion 3L and the anti-stretch section 4 of the main body right portion 3R.

The configuration of the anti-stretch section 4 will be described in more detail based on an encircled cross-sectional view of FIG. 1. As shown in the cross-sectional view, the anti-stretch section 4 includes a pipe-form knitted fabric portion 40 configured with a knitting yarn including the heat fusible yarn, and an inserting knitting yarn 41 inserted into the pipe-form knitted fabric portion 40 and fixed by tuck to the stitches configuring the pipe-form knitted fabric portion 40.

The pipe-form knitted fabric portion 40 is configured by an inner knitted fabric part 40*i* and an outer knitted fabric part 40*o* overlapping in a thickness direction of the instep cover section 3. The pipe-form knitted fabric portion 40 is formed to a pipe-shape by joining a starting end in a wale direction of the inner knitted fabric part 40*i* and a starting end in a wale direction of the outer knitted fabric part 40*o* at a position indicated with an arrow head "a", and joining a terminating end in the wale direction of the inner knitted fabric part 40*i* and a terminating end in the wale direction of the outer knitted fabric part 40*o* at a position indicated with an arrow head "b". The knitting width direction of the pipe-form knitted fabric portion 40 coincides with the extending direction of the pipe-form knitted fabric portion 40. The inner knitted fabric part 40*i* is a knitted fabric part that connects the portions that are separate from each other in the wale direction of the instep cover section 3, but may be assumed as a part of the instep cover section 3.

The number of courses (number of stitch rows lined in the wale direction) of the outer knitted fabric part 40*o* in the present example is greater than the number of courses of the inner knitted fabric part 40*i*. Thus, the cross-sectional shape of the pipe-form knitted fabric portion 40 has a substantially D-shape projecting toward the outer side of the shoe upper 1. With the pipe-form knitted fabric portion 40 having such shape, the inner peripheral surface of the instep cover section 3 can be made smooth without the pipe-form knitted fabric portion 40 projecting out toward the inner side of the instep cover section 3, and hence the comfortableness of the shoe upper 1 can be enhanced.

The pipe-form knitted fabric portion 40 having the above configuration is knitted with the fusible knitting yarn including the heat fusible yarn, as previously described above. This is so that when the fusible knitting yarn is subjected to heat treatment, the heat fusible yarn is molten and solidified, thus creating the pipe-form knitted fabric portion 40 that is less likely to stretch. Furthermore, the inserting knitting yarn 41, to be described later, can be fused in the pipe-form knitted fabric portion 40 by performing heat treatment on the fusible knitting yarn of the pipe-form knitted fabric portion 40, so that the pipe-form knitted fabric portion 40 and the inserting knitting yarn 41 can be integrated. Moreover, a state in which the inner knitted fabric part 40*i* and the outer knitted fabric part 40*o* configuring the pipe-form knitted fabric portion 40 are closely attached, and a hollow area is not formed between the knitted fabric parts 40*i* and 40*o* is realized by performing heat treatment on the fusible knitting yarn. In such a case, the pipe-form knitted fabric portion 40 and the inserting knitting yarn 41 are more strongly integrated, and the anti-stretch effect of the anti-stretch section 4 is enhanced.

The inserting knitting yarn 41 to be inserted inside the pipe-form knitted fabric portion 40 is extended along the extending direction of the hole of the pipe-form knitted fabric portion 40, and fixed by tuck to the stitches configuring the pipe-form knitted fabric portion 40 at a predetermined interval (in the encircled cross-sectional view, a state fixed by tuck is shown in a simplified manner). The interval (interval in depth direction in the plane of drawing) of the tuck is not particularly limited. For example, the inserting knitting yarn 41 can be tucked to every five to ten stitches in the knitting width direction of the pipe-form knitted fabric portion 40. Furthermore, the number of inserting knitting yarns 41 to be inserted inside the pipe-form knitted fabric portion 40 is not particularly limited. The greater the number of inserting knitting yarns 41, the more the anti-stretch effect by the anti-stretch section 4 can be enhanced. The inserting knitting yarn 41 is fixed to the outer knitted fabric part 40*o* in the present example, but may be fixed to the inner knitted fabric part 40*i*.

The inserting knitting yarn 41 may be inserted over the entire length of the pipe-form knitted fabric portion 40, or may be inserted over a part of the entire length. Of course, the anti-stretch effect by the anti-stretch section 4 can be more enhanced if the inserting knitting yarn 41 is inserted over the entire length of the pipe-form knitted fabric portion 40.

The inserting knitting yarn 41 is configured with a high strength knitting yarn that is less likely to stretch. For example, a high strength knitting yarn configured with nylon, polyester, aramid, polypropylene, carbon fiber, metal fiber, and the like can be used for the inserting knitting yarn 41.

<<Method for Knitting Shoe Upper>>

Figure 2:
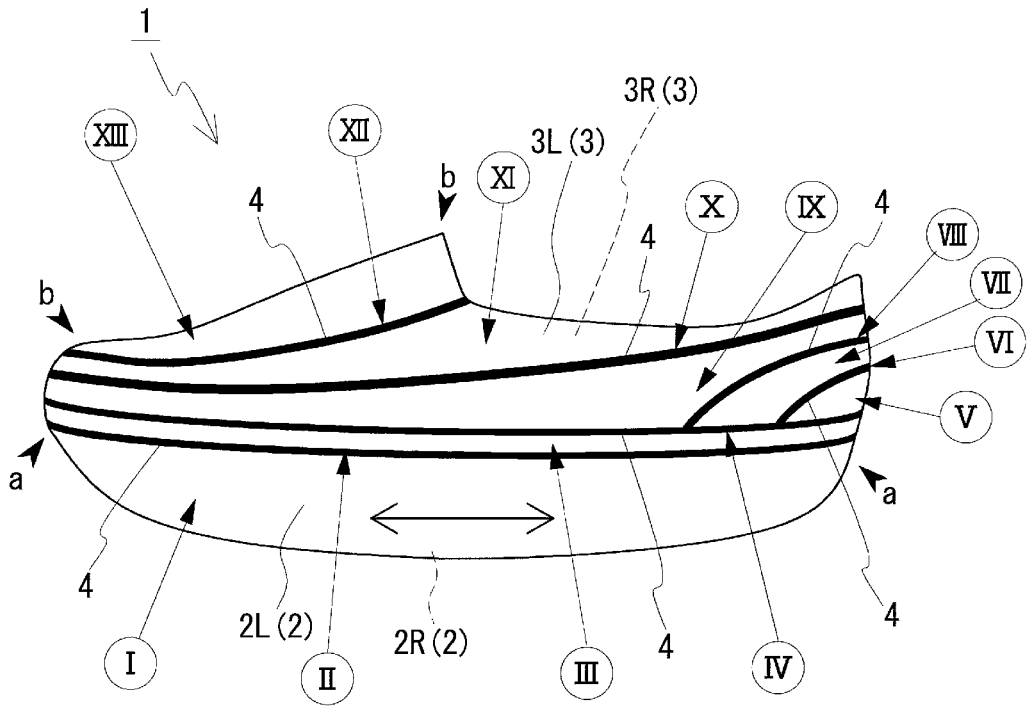
FIG. 2 is a schematic view showing a knitting procedure of the shoe upper of the first embodiment.

The shoe upper 1 can be knitted by a knitting method of knitting from the sole side toward the instep side of the shoe upper 1. The procedure will be described based on the schematic view of FIG. 2. In the schematic view, the left side portion of the shoe upper 1 is shown, and the right side portion of the shoe upper 1 is arranged on the far side in the plane of drawing, where the left side portion is knitted with the one-side needle bed and the right side portion is knitted with the other-side needle bed (double headed arrow indicates the knitting width direction). The encircled Greek numeral in the schematic view indicates the order of knitting of each location.

First, a set up section (lower end line between arrow heads "a") across both the one-side needle bed and the other-side needle bed is knitted, and the sole cover section 2 is knitted based on such set up section (portion of Greek numeral I is knitted). In the knitting of the sole cover section 2, the left side portion (sole left portion 2L) and the right side portion (sole right portion 2R) of the sole cover section 2 are knitted with the one-side needle bed and the other-side needle bed, respectively. The ratio of the sole left portion 2L and the sole right portion 2L is not particularly limited.

Then, the main body left portion 3L is knitted following the terminating end in the wale direction of the sole left portion 2L held on the one-side needle bed, and the main body right portion 3R is knitted following the terminating end in the wale direction of the sole right portion 2R held on the other-side needle bed. When the sole cover section 2 is not to be integrally knitted with the instep cover section 3, the main body left portion 3L is set up with the one-side needle bed and the main body right portion 3R is set up with the other-side needle bed, and then the main body left portion 3L and the main body right portion 3R are knitted based on each set up section.

The main body left portion 3L and the main body right portion 3R can be knitted by appropriately combining the C-shaped knitting and the tubular knitting. That is, the main body left portion 3L and the main body right portion 3R are alternately knitted while being arranged in parallel in the opposing direction of the FB and the BB. In this case, a state in which the main body left portion 3L and the main body right portion 3R are joined at the toe side and the heel side of the shoe upper 1 is to be realized. For example, the portion of Greek numeral III may be knitted mainly by tubular knitting, and the portion of Greek numerals V and VII may be knitted mainly by C-shaped knitting.

While knitting the instep cover section 3 configured by the main body left portion 3L and the main body right portion 3R, that is, while alternately knitting both portions 3L, 3R, the knitting of the anti-stretch section 4 (portions of Greek numerals II, IV, VI, VIII, X, XII) is appropriately carried out. An inclination angle of each anti-stretch section 4 can be changed by adjusting the number of knitting of the Greek numerals III, V, VII, IX, and XI. For example, the inclination angle of the anti-stretch section 4 indicated with the Greek numeral VI can be increased by increasing the number of knitting on the heel side of the portion of Greek numeral V more than on the toe side. The specific knitting method of the anti-stretch section 4 will be described later with reference to the knitting process diagram of FIG. 3.

Lastly, the portions (upper end line between arrow heads "b") on the toe side with respect to the foot insertion opening at the terminating ends in the wale direction of the main body left portion 3L and the main body right portion 3R are joined by knitting, and the other portions are performed with end processing and removed from the needle beds. The knitted shoe upper 1 is then fitted into the last and subjected to heat treatment to obtain the shoe upper 1 shown in FIG. 1.

[Knitting Method of Anti-stretch Section]

One example of a basic knitting method of the anti-stretch section 4 will be described based on the knitting process diagram of FIG. 3. All anti-stretch sections 4 shown in FIG. 2 can be knitted with the knitting method similar to the knitting process diagram of FIG. 3.

Figure 3:
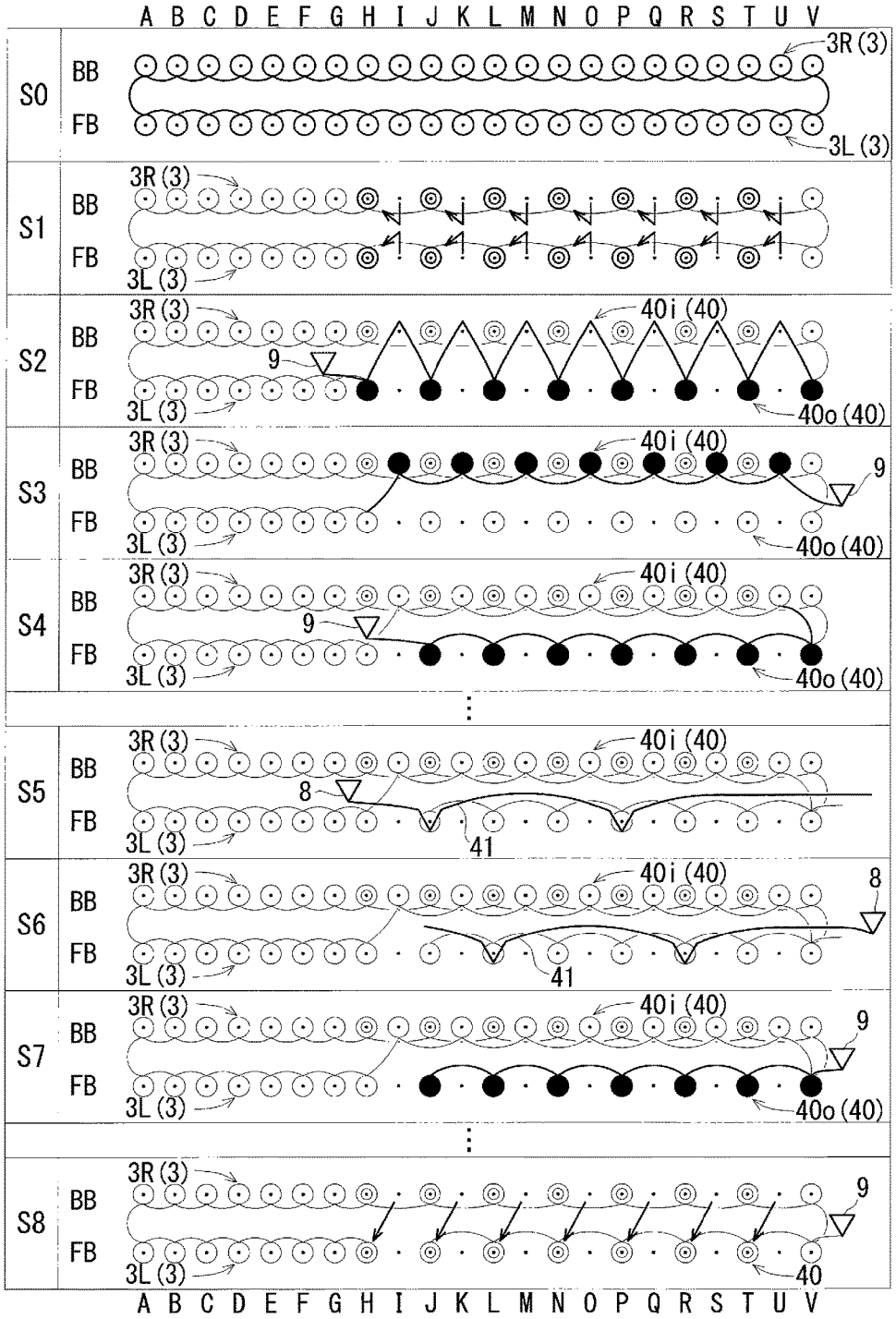
FIG. 3 is a knitting process diagram of an anti-stretch section of the shoe upper.

S+ number in the left column of the knitting process diagram of FIG. 3 indicates the number of the knitting process, and the right column indicates the held state of the knitting needles on the needle beds. A circle mark in the right column indicates a stitch, a double circle mark indicates a double stitch, an inverted triangle mark indicates a yarn feeder, a V-shaped mark indicates a pickup stitch or a tuck stitch, and a thick arrow indicates direction of transfer. Furthermore, a black dot indicates the knitting needle of the one-side needle bed (hereinafter referred to as FB) and the other-side needle bed (hereinafter referred to as BB), and an upper case alphabet indicates the position of the knitting needle. The number of stitches displayed is less than the number in the actual knitting.

S0 shows a state in which the stitches of the main body left portion 3L are held on the knitting needles of the FB, and the stitches of the main body right portion 3R are held on the knitting needles of the BB. In this example, an empty needle is not provided between the adjacent stitches, but both portions 3L, 3R may be knitted with stitches held on every other knitting needle (half gauge state).

In S1, the stitches of the main body left portion 3L (main body right portion 3R) held on the knitting needles I, K, M, O, Q, S, U of the FB (BB) are moved by one needle in the leftward direction of the plane of drawing, and double stitches are formed on the knitting needles H, J, L, N, P, R, T of the FB (BB). S1 is carried out to form the empty needle within the knitting width of the instep cover section 3 to knit the anti-stretch section 4 within the knitting width of the instep cover section 3. When the instep cover section 3 is knitted in the half gauge state, S1 does not need to be carried out. Furthermore, S1 also does not need to be carried out when using the four-bed flat knitting machine.

In S2, the knitting of the pipe-form knitted fabric portion 40 is started within the knitting width of the main body left portion 3L. Specifically, a yarn feeder 9 is moved in the leftward direction to alternately feed the knitting yarn including the heat fusible yarn to the knitting needles H, J, L, N, P, R, T, V of the FB and the knitting needles I, K, M, O, Q, S, U of the BB to form the starting ends in the wale direction of the outer knitted fabric part 40*o* on the FB and to form the starting ends in the wale direction of the inner knitted fabric part 40*i* on the BB (corresponding to process α in the knitting method of the present invention). Since the knitting yarn is alternately fed to the FB and the BB, the starting ends of the parts 40*i*, 40*o* are joined with the same knitting yarn including the heat fusible yarn. In the present example, a yarn feeder different from the yarn feeder used for the knitting of the instep cover section 3 is used for the yarn feeder 9, but the yarn feeder same as the yarn feeder used for the knitting of the instep cover section 3 can be used.

In S3, the inner knitted fabric part 40*i* is knitted with the BB, and in S4, the outer knitted fabric part 40*o* is knitted with the FB (part of process β in the knitting method of the present invention). The knitting of the inner knitted fabric part 40*i* and the knitting of the outer knitted fabric part 40*o* are carried out at least one or more times. That is, the knitting of the knitted fabric part 40*i*, 40*o* may be carried out for a plurality of times respectively. In the present embodiment, the number of courses of the outer knitted fabric part 40*o* is set to be greater than the number of courses of the inner knitted fabric part 40*i* as shown in the encircled cross-sectional view of FIG. 1, therefore, the number of knitting of the outer knitted fabric part 40*o* is greater than the number of knitting of the inner knitted fabric part 40*i*.

After knitting a predetermined number of the inner knitted fabric parts 40*i* and the outer knitted fabric parts 40*o*, the knitting of the inserting knitting yarn 41 is carried out using the knitting yarn different from the knitting yarn of both parts 40*i*, 40*o* (part of process β in the knitting method of the present invention). Specifically, as shown in S5, a yarn feeder 8 is moved in the leftward direction, and the inserting knitting yarn 41 fed from the yarn feeder 8 is tucked to the stitches of the outer knitted fabric part 40*o* held on the knitting needles P, J of the FB. Furthermore, in S6, the yarn feeder 8 is moved in the rightward direction, and the inserting knitting yarn 41 fed from the yarn feeder 8 is tucked to the stitches of the outer knitted fabric part 40*o* held on the knitting needles L, R of the FB. The position to tuck the inserting knitting yarn 41 and the number of times to insert the inserting knitting yarn 41 are not particularly limited. The greater the number of insertions, the higher the anti-stretch effect by the inserting knitting yarn 41 becomes. Furthermore, the inserting knitting yarn 41 can also be tucked to the inner knitted fabric part 40*i*.

In S7, the yarn feeder 9 is moved to knit the outer knitted fabric part 40*o* with the FB. The inserting knitting yarn 41 can be fixed to the outer knitted fabric part 40*o* by this knitting of the outer knitted fabric part 40*o*. S7 may be omitted, and S8, to be described later, can be carried out.

The unit knitting having the knitting of the inner knitted fabric part 40*i*, the knitting of the outer knitted fabric part 40*o*, and the knitting of the inserting knitting yarn 41 as one unit can be repeated for a plurality of times. In this case, the inserting knitting yarn 41 of the $n^{th}$ unit knitting can be fixed to the outer knitted fabric part 40*o* by the knitting of the outer knitted fabric part 40*o* of the $n+1^{th}$ unit knitting. The anti-stretch section 4 of a desired size can be knitted by repeating the unit knitting for a plurality of times, so that the entire anti-stretch section 4 can be uniformly finished, and the anti-stretch effect can be enhanced.

After forming the pipe-form knitted fabric portion 40 to a desired size, the terminating ends in the wale direction of the inner knitted fabric part 40*i* held on the knitting needles I, K, M, O, Q, S, U of the BB are transferred to the knitting needles H, J, L, N, P, R, T of the FB, as shown in S8. After S8, the terminating ends in the wale direction of the inner knitted fabric part 40*i* and the terminating ends in the wale direction of the outer knitted fabric part 40*o* can be connected by performing knit following the double stitches of S8 (corresponding to process γ of the knitting method of the present invention).

After S8, the anti-stretch section 4 is formed with respect to the main body right portion 3R held on the BB. The formation of the anti-stretch section 4 is to be carried out with the knitting shown in S2 to S8 turned upside down. Two anti-stretch sections 4 formed on the left and right of the instep cover section 3 are thereby sequentially knitted.

[Other Knitting Methods of Anti-stretch Section]

In the knitting method referring to FIG. 3, a hole at the end in the knitting width direction of the anti-stretch section 4 formed in the main body left portion 3L and a hole at the end in the knitting width direction of the anti-stretch section 4 formed in the main body right portion 3R are not joined. On the contrary, holes of the left and right anti-stretch sections 4 can be connected. Specifically, a pickup stitch is formed on the knitting needles of the FB or the BB (not shown) on the right side of the knitting needle V each time the outer knitted fabric part 40*o* is knitted such as while proceeding from S3 to S4 of FIG. 3. Such pickup stitches are remained formed on the needle beds until the anti-stretch section 4 of the main body left portion 3L is completed. That is, a right side end in the knitting width direction of the outer knitted fabric part 40*o* stays remained on the needle bed. When knitting the anti-stretch section 4 of the main body right portion 3R, the pickup stitches remained on the needle bed are sequentially connected to the outer knitted fabric part 40*o* of the anti-stretch section 4 of the main body right portion 3R. The hole of the anti-stretch section 4 of the main body left portion 3L and the hole of the anti-stretch section 4 of the main body right portion 3R are thereby joined.

<Modified Embodiment 1-1>

The shoe upper 1 shown in FIG. 1 can be knitted in a direction opposite to the direction described in the first embodiment, that is, from the instep side toward the sole side. That is, the shoe upper 1 can be knitted in the order of Greek numeral XIII→I of FIG. 2. In such a case, a set up section corresponding to the upper end line between the arrow heads "b" is knitted, and then the main body left portion 3L is knitted with the one-side needle bed and the main body right portion 3R is knitted with the other-side needle bed based on such set up section. The anti-stretch section 4 is knitted according to the knitting method illustrated in FIG. 3 while knitting both portions 3L, 3R. After the knitting of the main body left portion 3L and the main body right portion 3R is finished, the sole left portion 2L is knitted following the terminating end in the wale direction of the main body left portion 3L held on the one-side needle bed and the sole right portion 2R is knitted following the terminating end in the wale direction of the main body right portion 3R held on the other-side needle bed. Lastly, the sole left portion 2L and the sole right portion 2R are joined to complete the shoe upper 1.

<Second Embodiment >

In a second embodiment, an example of knitting a shoe upper 1' in a vertical direction on the needle beds will be described based on the schematic view of FIG. 4. The way of viewing the schematic view is similar to the schematic view of FIG. 2. The double headed arrow in the figure indicates the knitting width direction of the instep cover section 3.

In the second embodiment, the knitting is carried out from the heel side toward the toe side of the shoe upper 1'. Specifically, a set up section corresponding to the lower end line between the arrow heads "a" is knitted, and then the instep cover section 3 and the sole cover section 2 are knitted and the anti-stretch section 4 is knitted in the order of the Greek numerals I to IX. The sole left portion 2L and the main body left portion 3L are knitted while being arranged side by side on the one-side needle bed, and the sole right portion 2R and the main body right portion 3R are knitted while being arranged side by side on the other-side needle bed, and the sole left portion 2L and the sole right portion 2R are joined on the sole side (left side in the plane of drawing) by the C-shaped knitting. The anti-stretch section 4 is knitted by the knitting method similar to the knitting method illustrated in the knitting process diagram of FIG. 3. Lastly, the left side portion and the right side portion of the shoe upper 1' are connected at the position of the upper end line between the arrow heads "b" to complete the shoe upper 1'.

According to the knitting method described above, the shoe upper 1' in which the knitting width direction of the instep cover section 3 is directed in the height direction (direction of sole to foot insertion opening) of the shoe upper 1', and the anti-stretch section 4 is substantially extended in the height direction of the shoe upper 1' is obtained. According to such shoe upper 1', the stretching of the shoe upper 1' (instep cover section 3) toward the outer side can be effectively suppressed. In addition, the shoe upper 1' (instep cover section 3) that is less likely to stretch toward the outer side fits to the foot when worn and excels in the comfortableness.

The set up method of the heel and the shape of the heel, as well as the manner of closing the toe are not particularly limited. For example, the technique described in International Patent Publication No. 2014/013790 can be used.

<Modified Embodiment 2-1>

Figure 4:
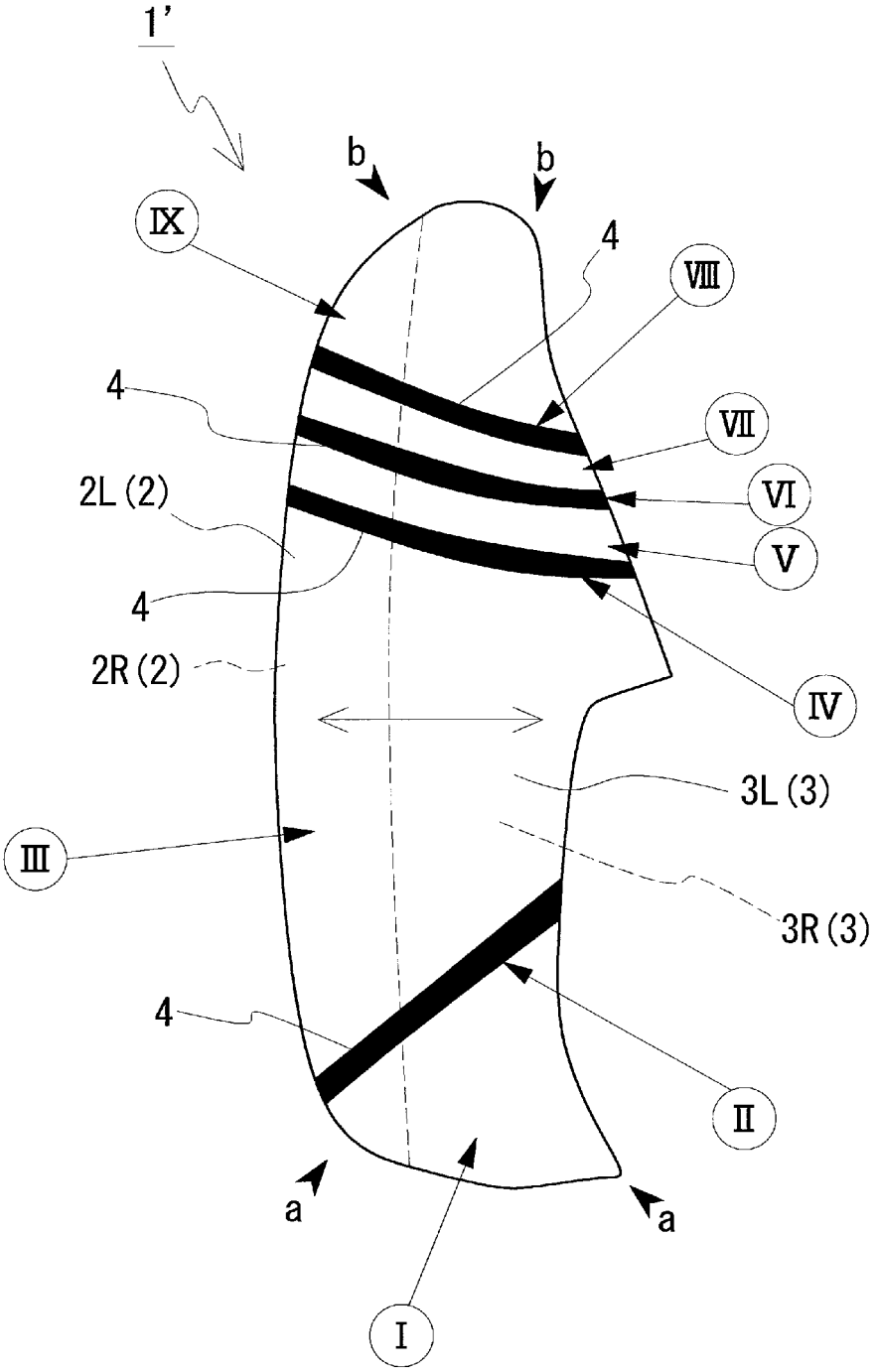
FIG. 4 is a schematic view showing a knitting procedure of a shoe upper according to a second embodiment.

The shoe upper 1' shown in FIG. 4 can also be knitted in the opposite direction from the second embodiment, that is, from the toe toward the heel. In such a case, the knitting is to be carried out in the order of Greek numeral IX→I of FIG. 4. The left side portion of the shoe upper 1' is knitted with the one-side needle bed, and the right side portion is knitted with the other-side needle bed.

<Modified Embodiment 2-2>

As opposed to the second embodiment and the modified embodiment 2-1, the main body left portion 3L and the main body right portion 3R of the instep cover section 3 can also be knitted while being arranged side by side in the longitudinal direction of the needle beds. In such a case as well, the anti-stretch section 4 formed in the instep cover section 3 can be knitted by the knitting method similar to the knitting method illustrated in the knitting process diagram of FIG. 3.

DESCRIPTION OF REFERENCE NUMERALS

1, 1' shoe upper
2 sole cover section
2L sole left portion
2R sole right portion
3 instep cover section
3L main body left portion
3R main body right portion
4 anti-stretch section
40 pipe-form knitted fabric portion
40*i* inner knitted fabric part
40*o* outer knitted fabric part
41 inserting knitting yarn
8, 9 yarn feeder
FB one-side needle bed
BB other-side needle bed

The invention claimed is:

1. A shoe upper including an instep cover section that covers a portion on an instep side of a wearer, the shoe upper comprising:

a linear anti-stretch section, integrally arranged in the instep cover section by knitting, for suppressing stretching of the instep cover section; wherein the anti-stretch section includes a pipe-form knitted fabric portion configured with a knitting yarn including a heat fusible yarn, and an inserting knitting yarn inserted inside the pipe-form knitted fabric portion and fixed by tuck to stitches configuring the pipe-form knitted fabric portion; and the pipe-form knitted fabric portion is configured by an inner knitted fabric part and an outer knitted fabric part that overlap in a thickness direction of the instep cover section, a starting end in a wale direction of the inner knitted fabric part and a starting end in a wale direction of the outer knitted fabric part being joined, and a terminating end in the wale direction of the inner knitted fabric part and a terminating end in the wale direction of the outer knitted fabric part being joined to form a pipe shape.

2. The shoe upper according to claim 1, wherein a knitting width direction of the instep cover section is directed in a lengthwise direction of the shoe upper.

3. The shoe upper according to claim 1, wherein a knitting width direction of the instep cover section is directed in a height direction of the shoe upper.

4. A method for knitting a shoe upper in which an instep cover section that covers a portion on an instep side of a wearer is knitted in a seamless manner using a flat knitting machine including a one-side needle bed and an other-side needle bed disposed opposite to each other, the method comprising:

knitting a linear anti-stretch section integrally formed in the instep cover section while knitting the instep cover section, the anti-stretch section including a pipe-form knitted fabric portion in which an inner knitted fabric part and an outer knitted fabric part overlapping in a thickness direction of the instep cover section are joined to a pipe shape, and an inserting knitting yarn inserted inside the pipe-form knitted fabric portion and fixed by tuck to stitches configuring the pipe-form knitted fabric portion; wherein the following processes α to γ are carried out in the knitting of the anti-stretch section:

process α of knitting a starting end in a wale direction of the inner knitted fabric part and a starting end in a wale direction of the outer knitted fabric part joined with a knitting yarn including a heat fusible yarn, process β of knitting the inner knitted fabric part and the outer knitted fabric part with different needle beds, feeding the inserting knitting yarn different from the inner knitted fabric part and the outer knitted fabric part between the knitted fabric parts, and fixing the inserting knitting yarn by tuck to stitches of the inner knitted fabric part or stitches of the outer knitted fabric part; and process γ of joining a terminating end in the wale direction of the inner knitted fabric part and a terminating end in the wale direction of the outer knitted fabric part by knitting.

* * * * *